United States Patent [19]

Crews et al.

[11] 4,373,681

[45] Feb. 15, 1983

[54] METHOD AND APPARATUS FOR CONTROLLING A STRAND TAKEUP REEL SHROUD

[75] Inventors: Edgar W. Crews, Mesa; Charles E. Sprain, Phoenix, both of Ariz.

[73] Assignee: Western Electric Company, Inc., New York, N.Y.

[21] Appl. No.: 301,809

[22] Filed: Sep. 14, 1981

[51] Int. Cl.[3] ..... B65H 54/02; B65H 67/04

[52] U.S. Cl. ..... 242/25 A

[58] Field of Search ..... 242/25 A, 25 R, 18 A, 242/19

[56] References Cited

U.S. PATENT DOCUMENTS

| | | | |
|---|---|---|---|
| 3,698,652 | 10/1972 | Morikawa et al. | 242/25 A |
| 3,761,030 | 9/1973 | Leinonen et al. | 242/25 A |
| 3,877,653 | 4/1975 | Foltyn et al. | 242/25 A |
| 3,913,858 | 10/1975 | Ikegami | 242/25 A |
| 4,015,785 | 4/1977 | Ikegami et al. | 242/25 A |
| 4,223,848 | 9/1980 | Brokke et al. | 242/25 A |

*Primary Examiner*—Stanely N. Gilreath

*Attorney, Agent, or Firm*—David P. Kelley

[57] ABSTRACT

A method and apparatus are disclosed for controlling high speed strand takeup reel shrouds during reel crossover by moving the shrouds once the output speed of the reel motors have deaccelerated to a preselected rate.

3 Claims, 5 Drawing Figures

METHOD AND APPARATUS FOR CONTROLLING A STRAND TAKEUP REEL SHROUD

TECHNICAL FIELD

This invention relates generally to high speed strand takeup machines, and particularly to methods and apparatuses for controlling movement of the takeup machine shrouds.

BACKGROUND OF THE INVENTION

Today, machines are used for winding strand materials such as wire and cable onto reels at high speeds. Exemplary of these are those disclosed in U.S. Pat. Nos. 3,877,653 and 4,223,848 which are assigned to the assignee of the present invention. These machines have means for mounting and rotating two takeup reels side-by-side about two parallel reel axes and for alternately feeding strand material to one of the reels being rotated at high speed while the other reel is being loaded or unloaded or stationed in a standby position.

Strand takeup machines have also had means for automatically terminating the feed of strand material to the rotating reel once it has been filled and for then transferring strand feed onto the other, empty reel. This changeover apparatus, which is sometimes referred to as strand cutover, crossover or transfer apparatus, typically has a distributor through which the strand material is guided that is mounted for reciprocal movement over the reel hubs in evenly filling the reels and also for stepped movement between several specific positions over the two reels in effecting reel changeover. The changeover apparatus has further included a strand deflector arm mounted for movement between and below the two reel axes of rotation, and a snagger mounted to each reel mount adjacent one rim of each reel.

In effecting changeover an empty reel stationed aside the filling reel is first accelerated to bring the speed of its hub to the advance speed of the strand material. The distributor is then moved from a path of reciprocating travel over the entire hub of the reel being filled with strand to a path over and somewhat beyond the axis of the empty reel. At this time a shroud is moved into a position over the full reel snagger to prevent the strand from being snagged by it. The deflector arm is then moved downwardly and horizontally causing it to engage the strand material being fed from the distributor onto the filling reel and to deflect it into engagement with the snagger now rotating at high speed beside the empty reel. Once that snagger engages the strand it severs it and holds the severed strand end of the supply source to the rotating empty reel whereupon that reel now begins to fill. The shroud is then withdrawn from its position covering the full reel snagger and the full reel brought to a halt and replaced with an empty reel in anticipation of the next changeover operation.

Though high speed takeup machines of the type just described have performed well the reel changeover apparatus has not functioned as reliably as desired. Indeed, sometimes a changeover is entirely missed which forces a temporary shutdown of strand feed to the takeup machine. Since high speed takeup is often a terminal operation in a series of tandem operations performed on strand material during its manufacture, this shutdown may in turn necessitate a temporary shutdown of an entire manufacturing line.

Studies of changeover failures have revealed that improper timing related to the withdrawal of the reel shrouds during changeover is a causative factor. If the shroud is withdrawn too soon after strand severance then the strand end can fly about and become damaged or even catch on the other reel. If the shroud is withdrawn too late then convolutions of strand ballon outwardly from the full reel beneath the shroud and get caught under its lips. When the full reel is then halted and automatically replaced with an empty reel, these convolutions may break and become entangled. The broken ends may then interfere with the next crossover by striking and breaking the incoming strand. Bits and pieces of the strand material may also get caught under the snagger teeth and interfere with proper snagging of the incoming strand.

SUMMARY OF THE INVENTION

In one preferred form of the invention a method of controlling a shroud positionable by a shroud drive means between a snagger covering position about a strand takeup reel being driven by a motor and a snagger uncovering position inside the strand takeup reel comprises the steps of sensing the output speed of the strand takeup reel motor while the shroud is positioned in the covering position about the strand takeup reel, and generating and imputting a shroud retraction signal to the shroud drive means upon sensing the speed of the motor to have been reduced to a preselected rate.

In another preferred form of the invention apparatus for controlling a shroud retractable by shroud drive means from a snagger covering position about a strand takeup reel being driven by a motor to a snagger uncovering position aside the strand takeup reel comprises tachometer means for generating an electrical signal having a frequency representative of the motor output speed, means for comparing the signal frequency with a preselected frequency, and means for actuating the shroud drive means in response to the signal frequency detected by the signal comparing means as being equal to or less than the preselected frequency.

DETAILED DESCRIPTION

Figure 1:
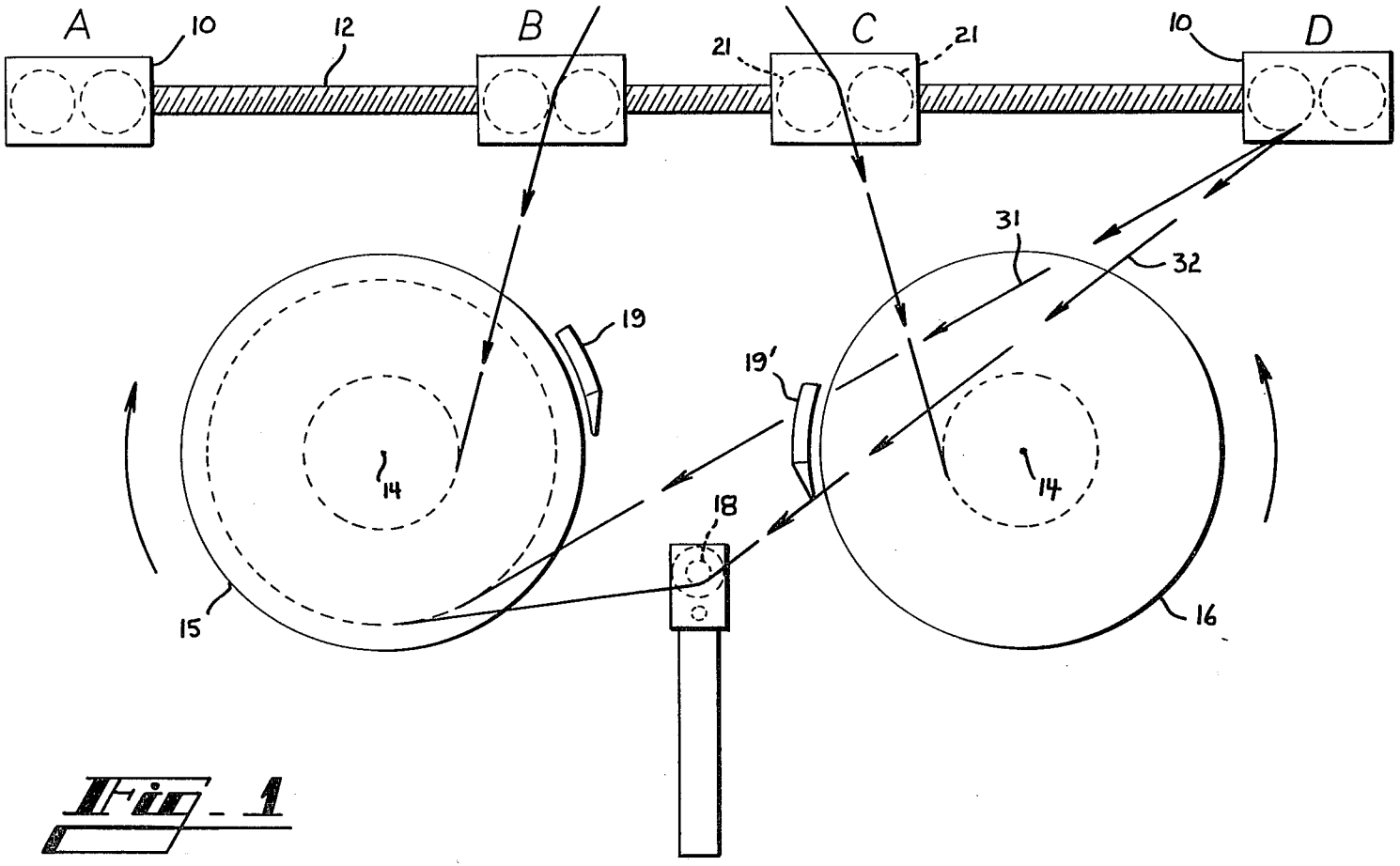
FIG. 1 is a diagrammatical end view of two takeup reels and reel changeover apparatus conventionally employed in a high speed strand takeup machine.

With reference next to FIGS. 1 and 2 changeover apparatus for a high speed strand takeup machine is seen to include a distributor head 10 mounted on a lead screw 12 for movement over the parallel axes 14 of reels 15 and 16 between positions A–D. The distributor head houses internal gearing that reciprocally drives a pair of sheaves 21 along idler shafts 24 that extend outwardly from the head to an end plate 25. The changeover apparatus also includes a strand deflector arm 18 mounted for movement by a cylinder 191 between the two reels during crossover. An unshown reel mount is provided for each reel with a strand snagger 19, 19' located on the mount adjacent one of the reel rims.

Figure 2A:
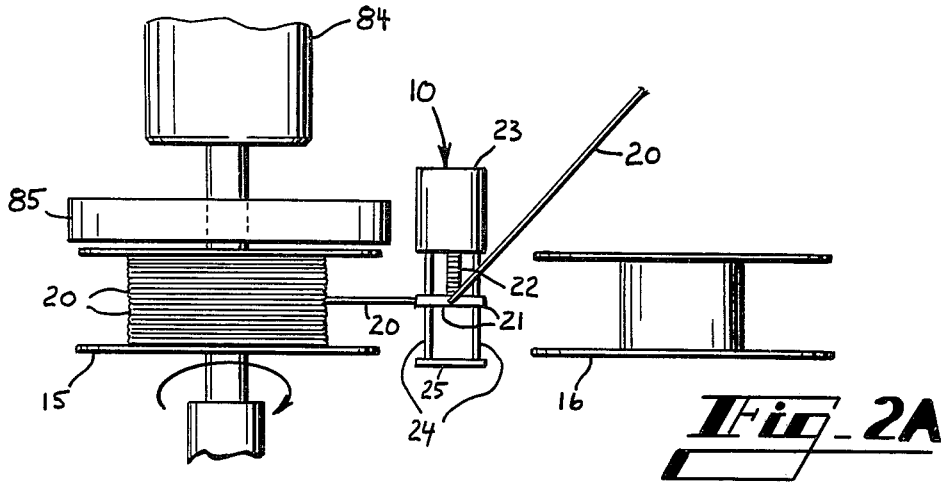
FIGS. 2A–2C are three sequential plan views of the reel changeover apparatus shown in FIG. 1 during a sequence of operation.
Figure 2B:
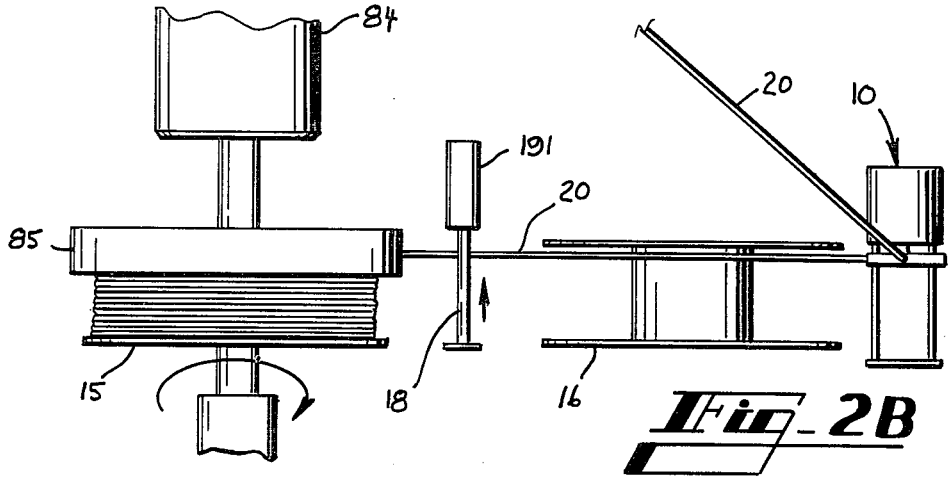
Figure 2C:
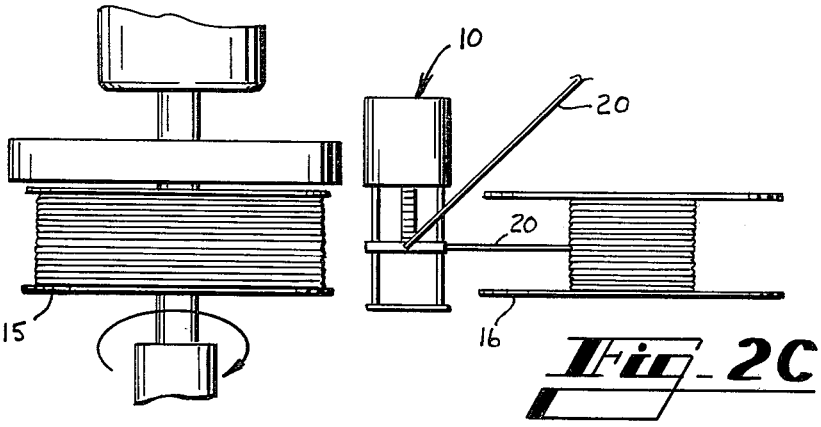

In FIG. 2 strand material 20 such as wire is seen being fed through the distributor sheaves 21 and then onto reel 15. As this occurs the sheaves are moved back and forth by the rack 22 thereby distributing the strand evenly onto the reel. In the position shown in FIG. 2A the reel 15 is taking up the strand material at a high rate of speed as it is driven by a motor 40 and motor drive shaft 45 with a shroud 85 positioned by a shroud drive motor 86 aside the reel hub over the mount snagger. After an unshown footage counter has reached a preselected count indicating the approach of a full reel condition a timer causes the distributor head to move from the position B shown in FIG. 1 to the position D which correspond to the movement of the distributor head 10 between the position shown in FIGS. 2A and 2B. The shroud 85 is also now moved to the position shown in FIG. 2B over the plane of the snagger orbit for reel 15. While at this position D reciprocal movement of the distributor sheaves is restricted to maintain strand travel slowly along the path shown in FIG. 2B. The timer then causes the deflector arm 18 to be moved in the position indicated by the arrow in FIG. 2B to deflect the strand material from path 31 to the path 32 shown in FIG. 1 that lies in the plane in which the snagger 19' is rotating. As this plane is traversed the angle of attack of the strand is generally right angular to the travel of one of the rotating snaggers as shown in FIG. 1. When the strand material is snagged it is severed at a point between the snagger and full reel and thereupon wrapped about the hub of the other empty reel. The distributor is then moved to the position C between the two reels as indicated in FIG. 2C. The position A is occupied instead of D during the changeover in the reverse direction.

Aside from the control of the shrouds 85 yet to be detailed, this crossover procedure is conventional and more fully described in the previously identified patents. In general, however, the shroud is moved by air cylinder 84 from its position shown in FIG. 2A aside reel 15 to its position over the snagger for that reel as shown in FIG. 2B just prior to movement of the deflector arm. It is retracted to its initial position as shown in FIG. 2C shortly after crossover has been effected and reel 16 begins to wind the strand.

Figure 3:
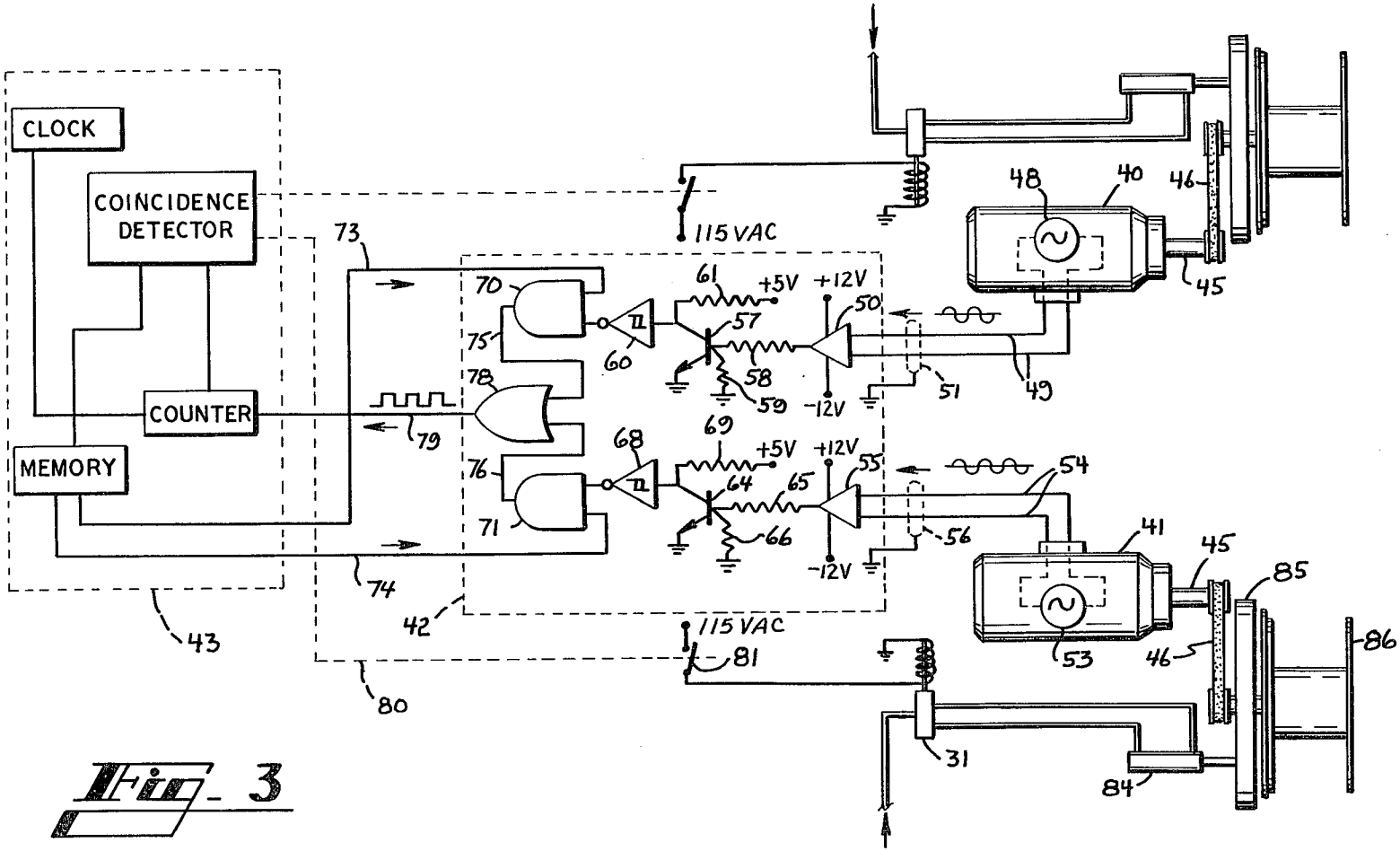
FIG. 3 is a schematic diagram of apparatus for controlling the shrouds of the two strand takeup reels during reel crossover operation in accordance with principles of the present invention.

With reference next to FIG. 3 apparatus for controlling shroud withdrawal or retraction is seen generally to comprise two variable output speed motors 40 and 41, a tachometer conversion circuit 42 and a computer 43. Each of the two motors has a drive shaft 45 coupled with a reel mount drive shaft by means of a belt 46 and pulleys mounted to each shaft. The motor 40 has a tachometer 48 for measuring the speed of its output shaft that is connected by lines 49 to an operational amplifier 50 member of the tachometer conversion circuit 42 through a noise suppressant shield 51. The motor 41 similarly has a tachometer 53 connected by lines 54 to another operational amplifier 55 member of the conversion circuit also through a noise suppressant shield 56. Each of the operational amplifiers, which may be Texas Instruments type TL081M, are configured as a differential operational amplifier by having their two VCC+ and VCC− terminals coupled to 320 12 VDC and −12 VDC power supplies, respectively. The output of the amplifier 50 is coupled with the base of a 2N2222 type NPN transistor 57 via a voltage divider network comprised of a 2 K resistor 58 and a grounded 1 K resistor 59. The transistor emitter is also grounded while its collector is coupled with a Schmitt trigger 60 and with a +5 VDC power supply via a biasing resistor 61. Similarly, the output of the amplifier 55 is coupled with the base of another 2N2222 type NPN transistor 64 via a voltage divider network comprised of a 2 K resistor 65 and a grounded 1 K resistor 66. The emitter of the transistor 64 is grounded while its collector is coupled with another Schmitt trigger 68 and with a +5 VDC power supply via a biasing resistor 69.

The output of the Schmitt trigger 60 is connected with an input terminal of a logic AND gate 70 while the output of the trigger 68 is connected with an input terminal of another logic AND gate 71. The other input terminal of the AND gate 70 is connected by line 73 to the memory unit of the computer 43 while the other input lead of gate 71 is connected by line 74 also with the computer memory. The outputs of the AND gates 70 and 71 are connected by lines 75 and 76, respectively, to an OR gate 78 whose output is connected by line 79 to the computer counter. The computer 43 itself is conventionally formed with memory, counter, coincidence detector and clock functions as schematically illustrated, each of which is coupled with an unshown central processing unit. An Intel SBC 80/20-4 single board computer is recommended.

In operation the computer 43 is reset to inform memory of which reel is to be wound with the strand material and which reel is to be in an idle or standby mode. For purposes of illustration it is assumed here that reel 86 is receiving strand material as motor 41 drives its mount. As convolutions of strand are built up on the reel it gradually slows. The output speed of its motor shaft 45 is made dependent upon motor input signals that are generated in a conventional manner so as to maintain a constant amount of tension on the strand. The motor output speed is sensed by the tachometer 53 which transmits a variable amplitude AC signal via lines 54 to the operational amplifier 55 member of the tachometer conversion circuit through the shield 56. Being configured as a differential operational amplifier the AC signal delivered to the base of transistor 64 is of a constant alternating amplitude of ±12 volts which is reduced by the voltage divider network to ±4 volts. This differential operational amplifier serves both to protect the tachometer circuit through circuit isolation and to shape the signal from a sinusodial into a square waveform.

As the transistor 64 is an NPN type anytime its base is negative it does not conduct. Whenever this occurs the Schmitt trigger input is at +5 VDC. Conversely, whenever the transistor base goes positive it conducts and the Schmitt trigger input is at ground potential. The trigger itself inputs either +5 VDC or 0 VDC to the logic components of the computer. The trigger thus is used essentially for further wave shaping and refinement, that is, to give very sharp pulse definition.

Each time the output from trigger 68 goes 5 volts positive the AND gate 71 outputs a positive 5 volt signal since both of its inputs are plus. This signal is then inputted to the computer 43 through the OR gate 78. Within the computer the counter counts the signal pulse rate and inputs that to the coincidence detector which compares this counted rate with a preselected rate. For example, a preselected pulse rate of 30 pulses/second represents a reel speed of 130 RPM and a motor output speed of 118 RPM for a Western Electric type 533 reel with the step down ratio of 20/22 for the particular transmission employed between motor drive shaft and reel mount. When coincidence is detected the detector transmits a signal over line 80 to close switch 81. This serves to actuate value 31 causing the air cylinder 84 to withdraw shroud 85 quickly, i.e., in less than one second, from about the snagger mounted to the mount for reel 86 as it slows. The computer is now reset whereupon the memory removes the positive voltage from AND gate 71 and places it upon AND gate 70.

Previously shroud retraction was initiated by timers activated at the start of crossover in response to strand footage counters having detected the approach of a full reel condition. This method assumed uniform slowing of the full reels. In actual practice however there has apparently existed a substantial variation in reel deacceleration. With the new method and apparatus these deviations have ceased to produce the problems previously mentioned occasioned by premature or tardy shroud retraction. The just described method and apparatus has provided a marked improvement in crossover reliability. Now shroud retraction consistently occurs at the same reel speed.

It should be understood that the just described embodiment merely illustrates principles of the invention in one preferred form. Many modifications, additions and deletions may, of course, be made thereto without departure from the spirit and scope thereof as set forth in the following claims.

What is claimed is:

1. A method of controlling a shroud positionable by shroud drive means between a snagger covering position about a strand takeup reel being driven by a motor and a snagger uncovering position aside the strand takeup reel, and with the method comprising the steps of sensing the output speed of the strand takeup reel motor while the shroud is positioned in the covering position about the strand takeup reel and generating and inputting a shroud retraction signal to the shroud drive means upon sensing the speed of the motor to have been reduced to a preselected rate.

2. The shroud control method of claim 1 wherein the output speed of the strand takeup reel motor is sensed by a tachometer that generates an AC signal representative of the motor speed, and wherein the shroud retraction signal is generated upon converting the AC signal to a digital signal whose freqency has been compared with a preselected frequency indicative of the preselected motor speed rate and found to have been reduced to the preselected rate.

3. Apparatus for controlling a shroud retractable by shroud drive means from a snagger covering position about a strand takeup reel being driven by a motor to a snagger uncovering position aside the strand takeup reel, and with the apparatus comprising tachometer means for generating an electrical signal having a frequency representative of the motor output speed, means for comparing the signal frequency with a preselected frequency, and means for actuating the shroud drive means in response to the signal frequency detected by said signal comparing means as being equal to or less than said preselected frequency.

* * * * *